US006030033A

United States Patent [19]

Schultz

[11] Patent Number: 6,030,033

[45] Date of Patent: Feb. 29, 2000

[54] CHAIR STRUCTURE

[75] Inventor: Jørgen Schultz, Galten, Denmark

[73] Assignee: A/S P. Schultz & Co., Galten, Denmark

[21] Appl. No.: 09/111,777

[22] Filed: Jul. 8, 1998

[30] Foreign Application Priority Data

Jul. 8, 1997 [DK] Denmark ..... 9700274

[51] Int. Cl.[7] ..... A47C 1/02

[52] U.S. Cl. ..... 297/84; 297/340; 297/423.36

[58] Field of Search ..... 297/68, 84, 85, 297/316, 322, 340, 354.12, 423.36

[56] References Cited

U.S. PATENT DOCUMENTS 1,852,811 4/1932 Koken et al. .
2,919,746 1/1960 Fidel .
3,244,449 4/1966 Re'.
3,269,769 8/1966 Mizelle .
4,690,454 9/1987 Mizelle .
4,844,536 7/1989 Mizelle .
5,056,862 10/1991 May et al. .
5,651,587 7/1997 Kodaverdian .
5,782,535 7/1998 Lafer .

*Primary Examiner*—Milton Nelson, Jr.
*Attorney, Agent, or Firm*—Sixbey, Friedman, Leedom & Ferguson; David S. Safran

[57] ABSTRACT

A chair of the type having a chassis and a seat portion connected with a reclinable backrest and a footrest which is pivotable between a passive parking position and a forwardly projecting carrier position. The backrest is swung rearwardly and the footrest forwardly in response to the seat portion behind displaced rearwardly relative to the chassis, and the backrest is separately adjustable in any position of the seat portion. The footrest is made as a telescopic plate structure which is extensible in response to being swung forwardly, based on the use of totally concealed actuator.

12 Claims, 2 Drawing Sheets

CHAIR STRUCTURE

BACKGROUND OF THE INVENTION

1. Field of the Invention

The present invention relates to a chair structure comprising a leg or wheel supported chassis, a seat element, an angularly adjustable backrest and a foot or leg rest element, which is pivotally connected with the front edge area of the seat element so as to be pivotable between a non-operative position underneath the seat element, preferably even slanting rearwardly from said front edge area, and a series of operative positions, in which it projects forwardly from said front edge area in a series of more and less inclined positions. Normally, such chairs are also provided with side pieces forming armrests and, besides, serving to hide the gear parts of the movable elements.

2. Description of Related Art

In most of the known chairs of this type there is a direct coupling between the pivoting of the backrest and the footrest, respectively, such that a rearward pivoting of the backrest is automatically linked with a forward pivoting of the footrest. This may be felt natural in many situations, but it is not universally convenient in view of individual requirements.

There is a specific problem connected with the use of the pivotable footrest, viz. that the length of this element is limited to a little less that the distance between the front edge area of the seat element and the floor, and such a length may not be sufficient to provide for a fully comfortable support for the legs and feet of the used. This drawback has been realised earlier and has been suggested overcome by arranging for a scissors link system at either side of the footrest in order to project this element forwardly in response to the swinging-up thereof; however, these link systems present their own problem in being visible at the opposite sides of the element, this being undesirable in connection with chairs of high quality design, where the different operative gear parts are desired to be practically invisible.

SUMMARY OF THE INVENTION

It is the purpose of the invention to provide a chair of the discussed type, which offers a high seating comfort, also with respect to the position adjustments of the backrest and the footrest, and yet enables a high quality furniture design.

According to a first aspect of the invention there is provided a chair structure, in which the pivoting of the footrest is controllable at least substantially independently of the pivot controlling of the backrest, whereby the user may select any angular position of the footrest, irrespectively of the angular position of the backrest, and vice-versa, of course amounting to maximum seating comfort.

According to another aspect of the invention the footrest element is provided as a telescopic plate structure which, in response to the swinging-out thereof, is caused to be extended by means of a mechanical control system arranged underneath the middle of the plate structure so as to be generally invisible from the surroundings of the chair and yet be expansible to a swing-up position, in which it may exhibit a length, which is larger that the distance to the floor and is convenient for a full support of the user's legs and feet, irrespectively of the inclination of the backrest.

In a manner known per se, the inclination of the backrest can still be controlled with the use of a gas spring, yet without or only slightly influencing the position of the seat element and the footrest.

According to the invention, a preferred manner of effecting pivoting of the footrest is by way of a length displacement of the seat element relative to fixed side members or armrests, whereby the footrest can be operated without any particulars or separate actuator means. In this connection, it has been found possible to design the system in such a manner that the footrest will remain swung away as long as a user is sitting in the chair, with the backrest more or less inclined, and is actuated to swing forwardly by the user urging the seat rearwardly to an area, where the weight of the used on the seat will be translated to an upwardly directed momentum on the footrest, sufficient for the supporting of the user's legs; should the user leave the chair while the footrest is in a operative position, the mere removal of the user's body will cause the said momentum to disappear so that the footrest will automatically, aided by suitable spring means, swing back to the passive position and pull the seat element forwardly into its starting position. All this conditions a very easy operation and a relatively simple design of the system.

BRIEF DESCRIPTION OF THE DRAWINGS

In the following the invention is described in more detail with reference to the drawing, in which.

DETAILED DESCRIPTION OF THE INVENTION

Figure 1:
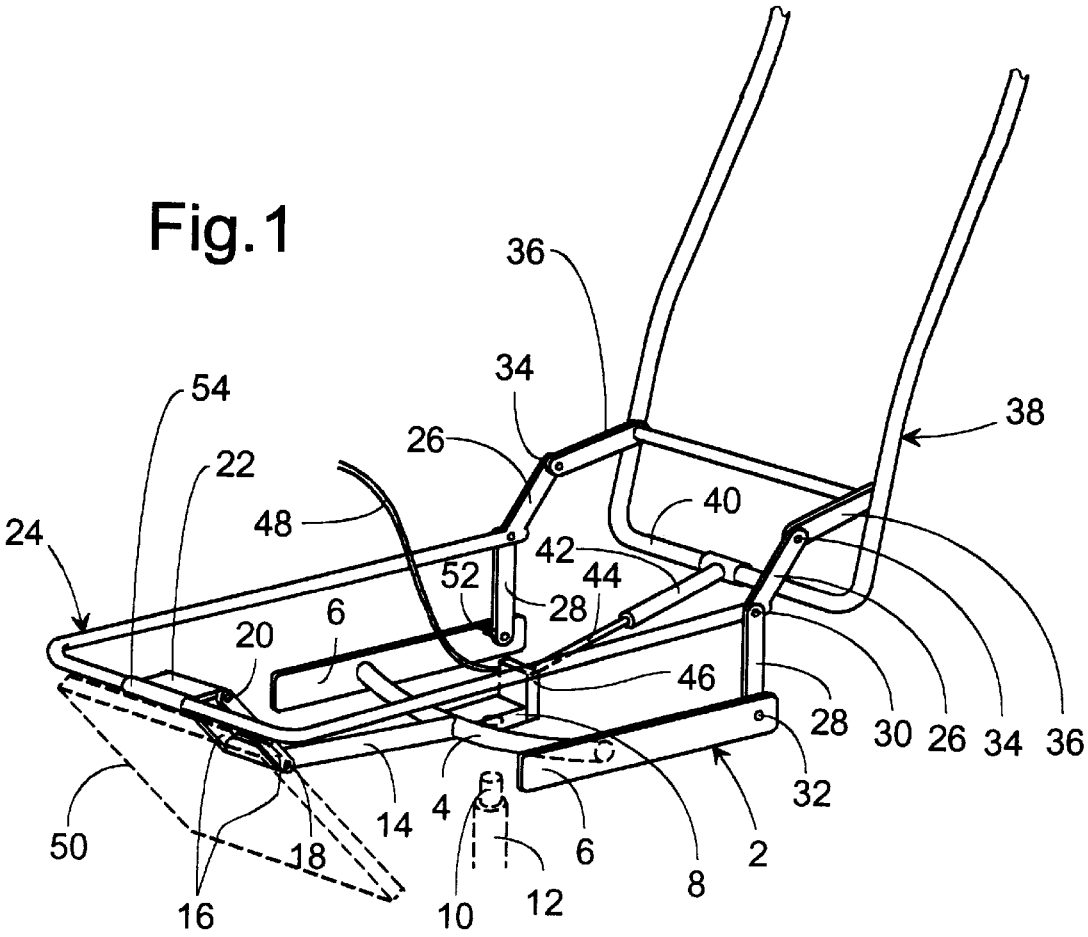
FIG. 1 is a perspective view of the chassis of a chair according to the invention.

The chair chassis shown in FIG. 1 comprises a base structure 2 including a cross rod or tube 4 carrying at either end a plate member 6 for holding respective, non-illustrated side pieces or armrest plate elements. At the middle of the cross rod 4 there is provided a horizontal box structure 8 having a lower hole for taking up an upwardly projecting pin portion 10 of an underlying support chassis 12, which may be leg or wheel supported. A carrier rod 14 projects forwardly from the middle of the cross rod 4, carrying at its front end two opposed pivot levers 16, which are pivotable about a cross pin 18 and, in the position shown, project forwardly and upwardly at an angle of approximately 45° with vertical, up to a pivot connection 20 with a block member 22 that is rigidly connected with the front part of a seat frame 24. This frame projects rearwardly, terminated by opposed, upwardly and rearwardly inclined flat iron members 26 rigidly connected with the ends of the frame 24. At the rear, the ends of the frame 24 are connected to the rear of the side plate members 6 through respective pivot levers 28, hinged at 30 and 32. In the normal sitting position as shown in FIG. 1, the levers 28 assume a position very close to vertical.

At 34, the upper ends of the rear frame members 26 are pivotally connected with arm members 36 rigidly fixed to and projecting forwardly from respective opposite side portions of an upright backrest frame 38 which, from that level, is extended downwardly to a lower cross portion 40. To a middle areas of this cross portion is pivotally connected one end of a gas cylinder 42, the piston rod 44 of which is vertically pivotably connected to a carrier element 46 rigidly associated with the chassis system 4,8. The outer end of the piston rod 44 has, in well known manner, a valve member that can be operated through a bowden cable 48 from a suitable operation member such as a draw handle placed at some suitable location in the chair.

As indicated in dotted lines at the front of the chair, the front portion of the seat frame 24 is connected with a footrest element 50, which is pivotable between the position shown, i.e. a downwardly and rearwardly inclined and partly hidden position in connection with a normal sitting position of the seat frame 24, and a forwardly projecting, leg and foot carrying position. However, before going into detail with this, the movability of the seat and backrest frames should first be briefly discussed:

When the seat frame 24 is loaded, the foremost pivot levers 16 will be influenced to pivot forwardly and downwardly, this seeking to push the frame 24 forwardly. However, somewhere in the system suitable stop means are provided for preventing such a movement, e.g. a stop pin 52 on the side plates 6 preventing forward pivoting of the rear levers 28. In other words, the load of a sitting person will stabilize the position shown. In that position, the sitting person may adjust the angular position of the backrest frame 38 in a fully conventional and independent manner by pressing the backrest rearwardly or letting it be swung forwardly, with associated use of the operation handle of the bowden cable 48.

Figure 2:
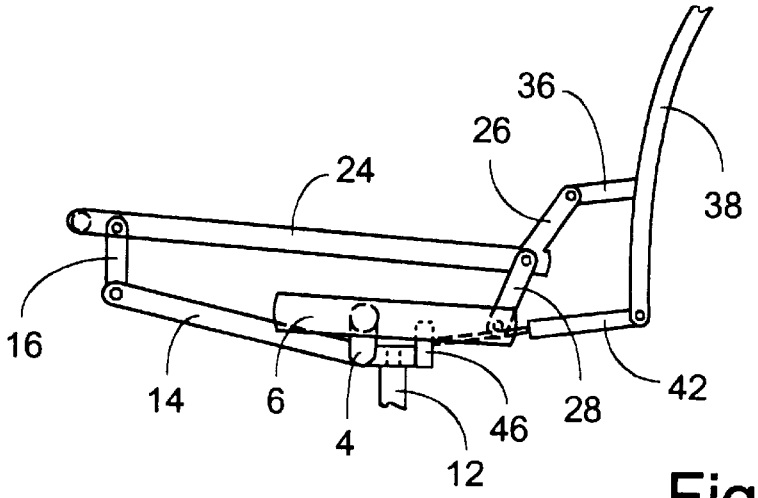
FIG. 2 is a side view thereof.

However, the sitting person may deliberately apply a rearwardly directed displacement force to the seat frame 24, in pushing by the underlegs against the floor and/or by gripping in the fixed side plate or armrest pieces of the chair, and such an influence will relatively easily overcome the "weight locking" of the foremost pivot levers 16, such that these are pivoted rearwardly about their lower pivots 18, while the rear support levers 28 will then be swung correspondingly rearwardly and downwardly about their lower pivots 30, this position being shown in FIG. 2.

It is clearly observable that the seat frame 24, by the said pivotings of the levers 16 and 28, will assume a position which is more rearwardly and downwardly slanting that in the sitting position shown in FIG. 1, i.e. the user now prepares for a position of rest. Admittedly, the position of the backrest frame will be somewhat influenced by this movement, but the user is still fully free to adjust the angular position thereof fully independently, typically arranging for the backrest to be tilted further rearwardly.

Now the weight of the user on the seat frame 24, due to the rearwardly inclined position of the rear support levers 28, will tend to promote a further rearward displacement of the seat frame, but in accordance with the invention this is counteracted by arranging for the said footrest 50 (FIG. 1) to be raised, carrying the weight of the user's underlegs and thus counteracting the further pressing down and displacement of the seat frame within a certain range of equilibrium.

Figure 3:
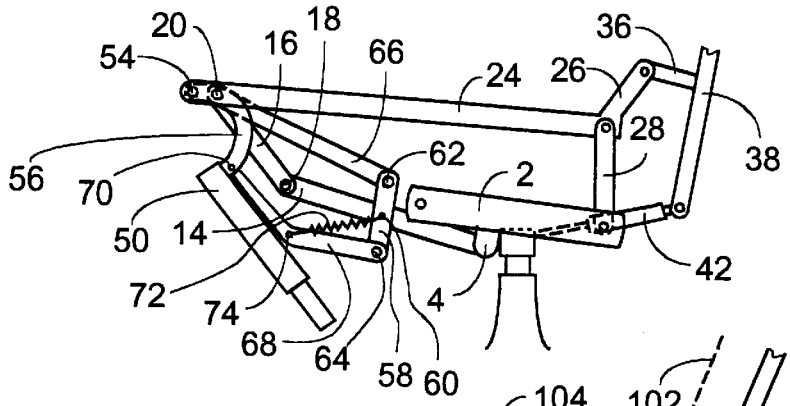
FIGS. 3–5 are similar side views of a chair completed with a footrest.
Figure 6:
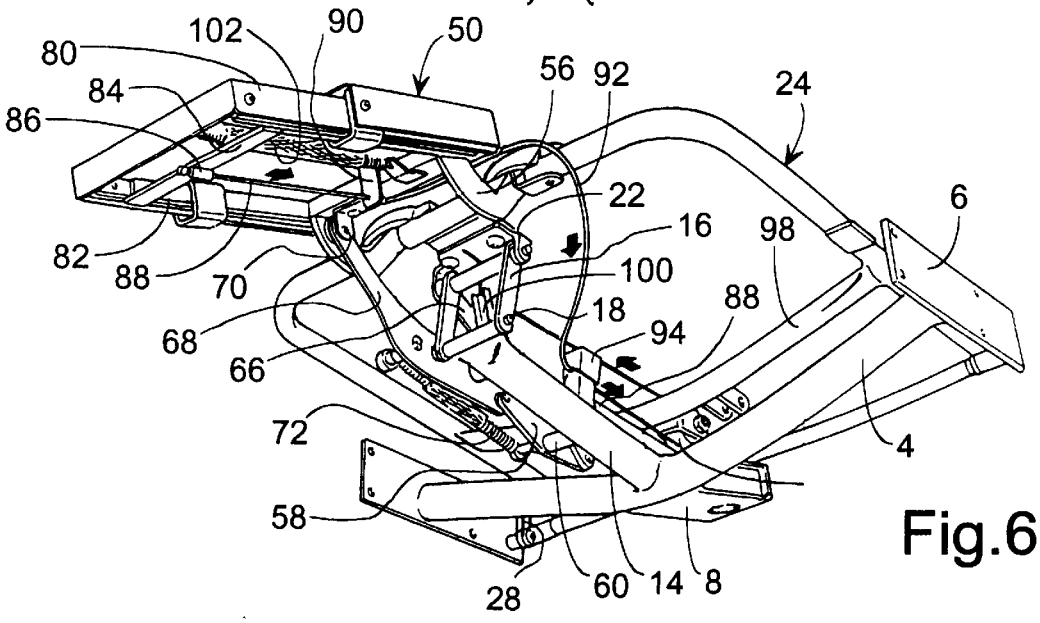
FIG. 6 is a perspective view of the chassis, seat and footrest structures of the chair according to FIGS. 3–5, seen from below.

This leads to the manner in which the footrest 50 is connected to the structure already described:

As indicated in FIG. 1, the seat frame 24 is provided with a bearing groove 54 at either side of the bracket 22, serving as hinging places for respective, curved carrier arms 56, the outer ends of which are rigidly secured to the footrest 50, FIG. 3, such that the system 50, 56 can swing forwardly about the bearings 54. A scissors system is provided, comprising a base lever 58, which is pivotally mounted on a pin 60 at a side of the carrier rod 14 and having an upper and a lower pivot bearing 62 and 64, an upper link arm 66 connecting the pivot points 62 and 20, and a lower, slightly curved link arm 68 connecting the pivot 64 with a similar point 70. A spring 72 is arranged between the pin 60 and a pin 74 on the lower link arm 68. Most of these parts are re-found in FIG. 6, which shows a practical embodiment of the system.

Figure 4:
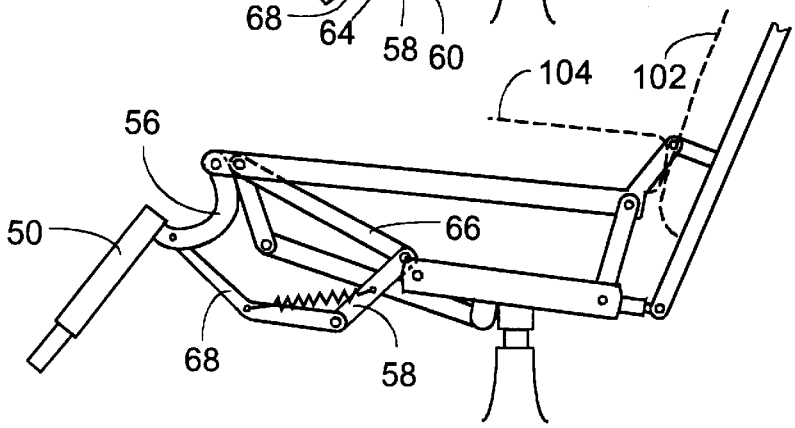
Figure 5:
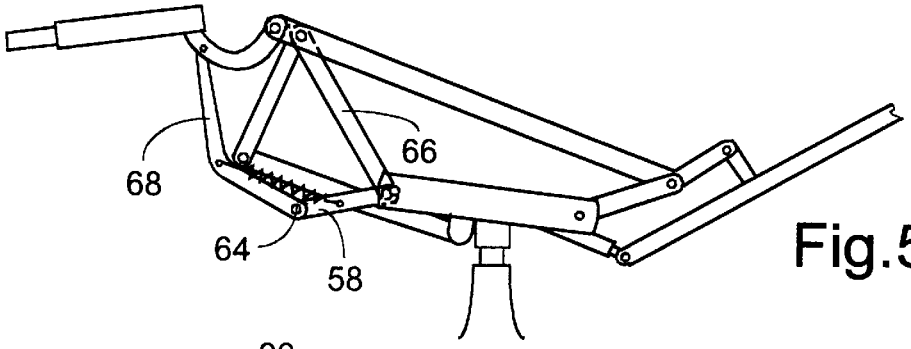

When the seat frame 24 is pushed rearwardly, FIGS. 4–5, the upper link arm 66 urges the base lever to rotate clockwise on the pin 60, whereby the lower link arm 68 is pushed forwardly, thus causing the associated carrier arm 56 and therewith the entire system 50, 56 to pivot forwardly, until a certain maximum has been reached (FIG. 5). It will be noted that in this position the weight of the user on the seat frame will operate to keep the seat frame in its rearwardly displaced position, thus stabilizing the footrest in its raised position, in which the link arm 68 cannot now urge the pivot point downwardly, as this should result in the link arm 66 being forced upwardly and forwardly. On the other hand, if the user leaves the chair in its FIG. 5 position, then the momentum of the footrest will be sufficient to cause a folding back of the system, helped by the spring 72. In use, the user may change position from FIG. 5 to FIG. 4 either by pressing down the foot rest or by pushing the seat element forwardly. The system is adaptable such that the chair will exhibit a desirable equilibrium through a series of positions.

In all positions, the backrest 38 can still be adjusted separately and individually.

As mentioned, the footrest 50 is made so as to be telescopically extensible in that the upper or inner part 50 serves to slidingly hold an interior extension plate 80. At the rear side, the part 50 is provided with outwardly shortly protruding rail plates 82, between which there is secured a traverse 84, which is thus a fixed member of the part 50. To this traverse there is, at 86 secured the outer end of a bowden wire 88, which passes through a hole on a bracket member 90 that is mounted on the extension plate 80 near the inner end thereof. The mantel of the bowden wire abuts this bracket 90, and the resulting bowden cable 92 leads to an anchoring block 94 on the carrier rod 14, where the other end of the bowden mantle tube is secured. Then the wire 88 continues around a roller 96 mounted on a cross rod 98 of the seat frame 24 and further to anchoring element 100 next to the pivot 18 of the carrier rod 14.

In this manner, when the seat frame is pushed rearwardly, this movement is translate, with transmission ratio 1:2 due to the roller 96, to the wire 88. Since the outer end 86 of the wire cannot be pulled inwardly, the whole cable loop 92 will be pulled against the fixed anchoring block 94, the pull resulting in an attempt to flatten out the loop 92, whereby an axial counter pressure is excerted on the bracket 90 by the end of the bowden mantle. This pressure result in the bracket 90 and therewith the entire unit 80 being pushed outwardly, so what really happens is that the bowden mantle is brought to shift its position on the wire 88. The degree of extension of the unit 80 will be a function of the rearward displacement of the seat frame, and the system is adjusted in such a manner that the footrest in passing through its vertical position is just free to go clear of the floor, while thereafter it is prolonged sufficiently to become a real footrest and not only a leg rest.

Whenever the footrest is swung down, a spring 102 between the parts 50 and 80 will effect retraction of the part 50 and thus retraction of the bracket 90 from its position near the wire fixture 86, this amounting to a relative pulling out of the wire 88 and therewith reentry into the mantle of the wire from the roller 96.

It will be appreciated that the gear means for controlling the pivoting and the extension of the footrest are mounted such that in use they will be practically invisible.

It will also be appreciated that for the user it will be possible to arrange for a "comfort position", in which the seat portion (104, FIG. 4) is inclined rearwardly and downwardly and the footrest 50, 80 is swung up and extended more or less, while the backrest (106, FIG. 4) is not necessarily leaned pronounced rearwardly, as the user may control the inclination of the backrest fully separately with the use of the gas cylinder 42.

I claim:

1. An inclination adjustable chair structure comprising a floor supported chassis carrying a seat portion, a backrest portion and a footrest portion, said seat portion being arranged so as to be rearwardly displaceable relative to said chassis and being coupled to said backrest portion through coupling means operable to tilt said backrest portion rearwardly in response to rearward displacement of the seat portion, the backrest portion also being connected to said seat portion and said chassis by an adjustment means which is operable to effect angular changes of the backrest portion independently of the position of the seat portion, said footrest portion being coupled to the chassis and the seat portion so as to be pivotable forwardly and upwardly in response to a rearward displacement of the seat portion.

2. A chair structure according to claim 1, wherein the footrest portion is made as a length variable double plate structure, of which an outer plate member is telescopically extensible in response to the pivoting out of the footrest portion by means of movement translating means located generally behind the footrest portion.

3. A chair structure according to claim 1, in which the seat portion is supported in such a manner that in a rearwardly displace position thereof the weight of a user loading the seat portion will add to the momentum acting on the footrest portion for urging the same pivotably forwardly/upwardly.

4. A chair structure according to claim 1, in which the footrest portion is coupled to the chassis and the seat portion through a scissors system arranged generally inside, underneath the footrest portion.

5. A chair structure according to claim 1, wherein the footrest portion is made as a length variable double plate structure, of which an outer plate member is telescopically extensible in response to the rearward displacement of the seat portion by means of movement translating means located generally underneath the footrest portion.

6. A chair structure according to claim 1, wherein the footrest portion is made as a length variable double plate structure, of which an outer plate member is telescopically extensible in response to the rearward displacement of the seat portion by means of movement translating means located generally behind the footrest portion.

7. A chair structure according to claim 1, wherein the footrest portion is coupled to the chassis and the seat portion through a scissors system arranged generally inside, behind the footrest portion.

8. A chair structure according to claim 1, in which the footrest portion is made as a length variable double plate structure, of which an outer plate member is telescopically extensible in response to the pivoting out of the footrest portion by means of movement translating means located generally underneath the footrest portion.

9. A chair structure according to claim 8, in which the telescoping plate member is extensible by means of a bowden cable connection to a rigid part of the chassis, from which the inner wire of the bowden cable is drawn out in response to the seat portion being rearwardly displaced.

10. A chair structure according to claim 9, wherein the bowden cable has a bowden wire and an associated bowden tube mantle; and wherein the outer end of the inner plate element of the footrest portion is extended in opposed guiding rail portions carrying between them a rigidly fixed traverse having anchoring means for the outer end of the bowden wire, while an innermost end portion of the extensible telescoping plate member has a bracket member for holding the outer end of the associated bowden tube mantle.

11. A chair structure according to claim 10, in which the bowden cable wire at the seat portion side thereof is connected with a wire roller connected with the seat portion, while an associated free end of the wire, at the other side of this roller is rigidly connected with the seat portion.

12. A chair structure according to claim 8, wherein the outer plate member is also telescopically extensible in response to the rearward displacement of the seat portion.

* * * * *